US005583088A

United States Patent [19]

Kawamura

[11] Patent Number: 5,583,088

[45] Date of Patent: Dec. 10, 1996

[54] REVERSIBLE THERMOSENSITIVE RECORDING MEDIUM

[75] Inventor: Fumio Kawamura, Shizuoka, Japan

[73] Assignee: Ricoh Company, Ltd., Tokyo, Japan

[21] Appl. No.: 496,411

[22] Filed: Jun. 29, 1995

[30] Foreign Application Priority Data

Jun. 29, 1994 [JP] Japan ..... 6-170019

[51] Int. Cl.[6] ..... B41M 5/128; B41M 5/26

[52] U.S. Cl. ..... 503/205; 503/201

[58] Field of Search ..... 427/150–152; 503/201, 205, 209, 217

[56] References Cited

U.S. PATENT DOCUMENTS 5,468,711 11/1995 Suzuki et al. ..... 503/201

*Primary Examiner*—Bruce H. Hess

*Attorney, Agent, or Firm*—Oblon, Spivak, McClelland, Maier & Neustadt, P.C.

[57] ABSTRACT

A reversible thermosensitive recording medium includes a substrate and a recording layer formed thereon, the recording layer including an electron donor coloring compound, an electron accepter compound capable of inducing color formation in the electron donor coloring compound, a decolorization promoting agent containing at least one long chain aliphatic compound including three hydroxyl groups at a terminal portion of the molecule thereof, and a binder resin.

6 Claims, No Drawings

REVERSIBLE THERMOSENSITIVE RECORDING MEDIUM

BACKGROUND OF THE INVENTION

1. Field of the Invention

The present invention relates to a reversible thermosensitive recording medium which utilizes the coloring reaction between an electron donor coloring compound and an electron acceptor compound capable of inducing color formation in the electron donor coloring compound.

2. Discussion of Background

Conventionally there have been proposed various reversible-color-changeable materials with application of heat thereto, such as metal complex salts, cholesteric liquid crystals, and mixed systems composed of an electron donor coloring compound (hereinafter referred to as a coloring agent), an electron acceptor compound (hereinafter referred to as a color developer) and a coloring and decolorization temperature controlling agent.

These reversibly-color-changeable materials are widely used, because of the reversibly color-changeable characteristics thereof, in a variety of fields, such as in the fields of temperature-measurement materials for measurement or control of temperature, various display devices, clothes, inks, toner, writing instruments, teaching materials, and toys.

In particular, reversibly color-changeable materials, which are composed of a coloring agent, a color developer and a color and decolorization temperature controlling agent as indispensible components, have been proposed for use in various fields because of the advantages thereof over other materials that a wide color-changeable temperature range can be set, sharp and large color changes can be obtained, a great variety of colors can be obtained, and such reversibly color-changeable materials are innoxious, as disclosed, for instance, in Japanese Patent Publications 51-44706, 51-44709, 52-7764, Japanese Laid-Open Patent Applications 63-15877, 63-251487, 1-121394 and 1-174591.

Most of the reversibly color-changeable materials composed of a coloring agent, a color developer and a coloring and decolorization temperature controlling agent are of a thermal decolorization type, in which a colored state obtained by the interaction between the coloring agent and the color developer is decolorized to a colorless state by the application of heat thereto.

Furthermore, there have been proposed reversibly color-changeable materials of a thermal color-development type, in which a colored state is reversibly produced from a colorless state by the application of heat thereto.

An example of a reversibly color-changeable material of such a thermal color-development type is proposed in Japanese Laid-Open Patent Application 4-14482. In this Application, a thermosensitive recording layer comprising a leuco dye, a color developer and a decolorization promoting agent is provided on a substrate, and the recording layer is colored with application of heat thereto, for example, by a word processor, and the developed color is then allowed to be decolorized with time.

In this reversibly color-changeable material, the recording density and erasability thereof are lowered in the course of the repetition of the color formation for recording and the erasure thereof.

The Applicants of the present invention have previously developed a reversible thermosensitive recording medium having a recording layer comprising a coloring agent and a color developer, which is capable of forming a stable colored recording state at room temperature by heating the coloring agent and the color developer to a color development temperature to fuse the coloring agent and the color developer, and also capable of changing the colored recording state to a decolorized state by heating the same to a temperature lower than the color development temperature, and maintaining the decolorized state stably at room temperature as disclosed, for instance, in Japanese Laid-Open Patent Application 5-124360. The erasability of images recorded in this reversible thermosensitive recording medium, however, cannot reach a satisfactory level when recording and erasure of images are repeated a number of times.

Furthermore, the Applicants of the present invention have proposed a reversible thermosensitive recording medium in Japanese Laid-Open Patent Application 5-69664, which is prepared by coating microcapsules containing a coloring agent, a color developer, a coloring and decolorization temperature controlling agent and a solvent with low volatility together with a binder resin on a substrate. The thus prepared reversible thermosensitive recording medium is excellent in (a) the thermal coloring performance from a colorless state to a colored state, (b) the erasability at room temperature, and (c) the repeated use characteristics thereof. However, the necessity for the formation of the microcapsules makes the production of this reversible thermosensitive recording medium difficult.

In addition, the Applicants of the present invention have discovered the following preferable decolorization promoting agents (1) to (8) for use in a reversible thermosensitive coloring composition comprising a coloring agent, a color developer and a decolorization promoting agent, as disclosed in Japanese Laid-Open Patent Application 5-294063:

(1) Fatty acids, and derivatives and metal salts of fatty acids; (2) waxes, fats and oils; (3) higher alcohols; (4) phosphoric esters, benzoic esters, phthalic esters, and hydroxy acid esters; (5) silicone oil; (6) liquid crystalline compounds; (7) surfactants; and (8) organic compounds having saturated hydrocarbon chains with 10 or more carbon atoms.

The Applicants of the present invention have discovered that in a reversible thermosensitive recording medium which comprises a substrate and a recording layer formed thereon comprising a coloring agent, a color developer and a decolorization promoting agent, a color formation step of forming a recording state with application of heat and a decolorization step of allowing the recorded state to stand under normal conditions can be repeatedly carried out by use of at least one material selected from the group consisting of higher alcohols, higher esters and higher amides as the decolorization promoting agent, as disclosed in Japanese Laid-Open Patent Application 6-155905.

The decolorization promoting agents disclosed in the above Japanese Laid-Open Patent Applications 5-294063 and 6-155905, however, are still insufficient for obtaining practically usable repeated use performance.

Thus, conventional reversible thermosensitive recording media utilizing the coloring reaction between a coloring agent and a color developer have various problems and are unsatisfactory for use in practice.

SUMMARY OF THE INVENTION

It is therefore an object of the present invention to provide a reversible thermosensitive recording medium which utilizes the coloring reaction between an electron donor coloring compound and an electron acceptor compound capable of inducing color formation in the electron donor coloring compound, which is capable of forming colored images with high thermal response by application of heat thereto, with the colored images being excellent in the erasability with time at room temperature, and which has excellent repeated use performance in the reversible color formation and erasure thereof.

This object of the present invention can be achieved by a reversible thermosensitive recording medium which comprises a substrate and a recording layer formed thereon. The recording layer comprises an electron donor coloring compound, an electron acceptor compound capable of inducing color formation in the electron donor coloring compound, a decolorization promoting agent and a binder resin, with the decolorization promoting agent comprising at least one long chain aliphatic compound including three hydroxyl groups at a terminal portion of the molecule thereof.

Preferable examples of the long chain aliphatic compound for use in the present invention are the following compounds (1), (2) and (3):

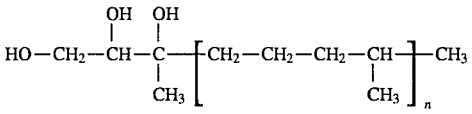

(1)

wherein n is an integer of 1 to 3;

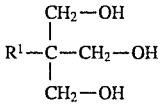

(2)

wherein $R^1$ is a straight or branched chain alkyl group or alkenyl group having 8 to 22 carbon atoms; and

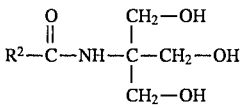

(3)

wherein $R^2$ is a straight or branched chain alkyl group or alkenyl group having 7 to 27 carbon atoms.

Furthermore, a decolorization promoting agent comprising the following acetylene glycol compound with formula (4) is also preferable for use in the present invention:

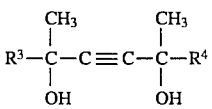

(4)

wherein $R^3$ and $R^4$ may be the same or different and represent an alkyl group having 1 to 4 carbon atoms.

DESCRIPTION OF THE PREFERRED EMBODIMENTS

As mentioned previously, the reversible thermosensitive recording medium of the present invention comprises a substrate and a recording layer comprising an electron donor coloring compound, an electron acceptor compound capable of inducing color formation in the electron donor coloring compound, a decolorization promoting agent and a binder resin, with the decolorization promoting agent comprising at least one long chain aliphatic compound including three hydroxyl groups at a terminal portion of the molecule thereof.

Specific examples of the above-mentioned long chain aliphatic compound including three hydroxyl groups at a terminal portion of the molecule thereof are the following three compounds:

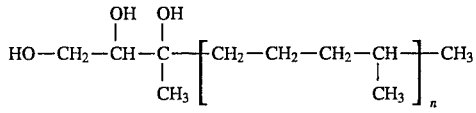

(1)

wherein n is an integer of 1 to 3;

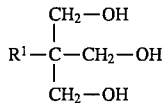

(2)

wherein $R^1$ is a straight or branched chain alkyl group or alkenyl group having 8 to 22 carbon atoms; and

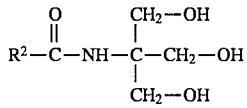

(3)

wherein $R^2$ is a straight or branched chain alkyl group or alkenyl group having 7 to 27 carbon atoms.

The above compounds (1) to (3) are conventionally known compounds which are used, for instance, in varieties of cosmetics. More specifically, the compound (1) is disclosed in Japanese Patent Publication 38-5050; and the compounds (2) and (3) are disclosed in Japanese Laid-Open Patent Application 4-69321.

A preferable example of the compound (1) is phytantriol, which is a compound (1) with formula (1) in which n is 3. Phytantriol is derived from phytol which is an alcohol—obtained by the decomposition of chlorophyll and is known as an alcohol component of chlorophyll.

Specific examples of the compound of formula (2) are trimethylolundecane, trimethyloltridecane, trimethylolpentadecane, trimethylolheptadecane, trimethylolnonadecane, and trimethylolheneicosane.

Of the compounds represented by formula (2), compounds with formula (2) in which $R^1$ is a branched alkyl group having 16 carbon atoms and a compound with the following formula (2a) are preferable for use in the present invention:

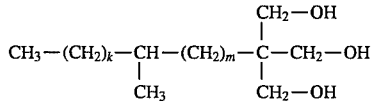

(2a)

wherein k and m are each an integer of 0 to 19, and k+m is an integer of 7 to 19.

Of the compounds represented by the above formula (2a), compounds of formula (2a) in which k+m is an integer of 11 to 15 are preferable, and a compound of formula (2a) in which k+m is 13, that is, trimethylolisoheptadecane, is particularly preferable. It is also preferable that a branched methyl group be positioned in a central portion of the alkyl chain in the compounds of formula (2a).

Compounds represented by general formula (2) can be produced by a conventional method disclosed in Japanese Laid-Open Patent Application 4-69321.

As the compound of formula (3), it is preferable that $R^2$ have 13 to 19 carbon atoms.

Specific examples of the acyl group ($R^2$—CO—) which constitutes a terminal portion of the compound of formula (3) are straight chain saturated acyl groups such as lauroyl group, myristoyl group, palymitoyl group and stearoyl group; straight chain unsaturated acyl groups such as oleyl group; and branched acyl groups such as isotearoyl group, 2-octyldecanoyl group and 2-heptylundecanolyl group.

As the acyl group ($R^2$—CO—), the following branched acyl groups and straight chain unsaturated acyl group with formulas (3a), (3b) and (3c) are preferable, and the acyl groups ($R^2$—CO—) in which $R^2$ has 13 to 19 carbon atoms are more preferable:

(3a)

wherein p and q are each an integer of 0 to 24; and p+q is an integer of 4 to 24.

Of the acyl groups represented by the above formula (3a), the acyl group of formula (3a) in which p+q is 14, that is, isostearoyl group is particularly preferable.

(3b)

wherein $R^5$ and $R^6$ are each independently an alkyl group having 2 to 12 carbon atoms.

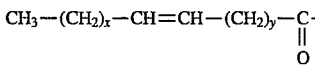

(3c)

wherein x and y are each an integer of 0 to 24; and x+y is an integer of 4 to 24.

The compounds of the above general formula (3) can be produced by a conventionally known method disclosed in Japanese Laid-Open Patent Application 4-69321.

Furthermore, a decolorization promoting agent comprising the following acetylene glycol compound with formula (4) is also preferable for use in the present invention:

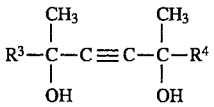

(4)

wherein $R^3$ and $R^4$ may be the same or different and are each an alkyl group having 1 to 4 carbon atoms.

Specific examples of the acetylene glycol compound of formula (4) are 2,5-dimethyl-3-hexyne-2,5-diol, 3,6-dimethyl-4-octyn-3,6-diol, and 2,4,7,9-tetramethyl-5-decyn-4,7-diol.

A coloring agent, a color developer and a binder resin for use in the recording layer of the reversible thermosensitive recording material of the present invention will now be explained in detail.

As the coloring agent for use in the recording layer of the reversible thermosensitive recording material of the present invention, an electron donor coloring compound is employed. There is no particular limitation to such an electron donor coloring compound as long as it is a colorless or pale colored dye precursor. Therefore as such compounds, conventionally known triphenylmethane phthalide compounds, fluoran compounds, phenothiazine compounds, leuco auramine compounds, rhodamine lactam compounds, spiropyran compounds and indolinophthalide compounds can be employed.

Specific examples of the above compounds are as follows:

3,3-bis(p-dimethylanilino)phthalide,
3,3-bis(p-dimethylanilino)-6-chlorophthalide,
3,3-bis(p-dimethylanilino)-6-diethylaminophthalide,
3,3-bis(p-dimethylanilino)-6-dimethyolaminophthalide (another name: Crystal Violet lactone),
3-(2-hydroxy-4-diethylanilino-3-(2-methoxy-5-tolyl)phthalide,
3,6-bis(dimethylanilino)fluorenespiro(9,3')-6'-dimethylaminophthalide,
3-(2-methoxy-4-dimethylanilino)-3-(2-hydroxy-4-chloro-5-tolyl)phthalide,
3-(2-hydroxy-4-dimethylanilino)-3-(2-methoxy-5-nitrophenyl)phthalide,
2-[(3,6-bis(diethylamino)]-9-(o-chloroanilino)xanthylbenzoic acid lactam,
6'-bromo-3'-methoxybenzoindolinospiropyan,
6'-chloro-8'-methoxybenzoindolinospiropyran,
Benzoyl Leucomethylene Blue,
3-cyclohexylamino-6-chlorofluoran,
3-diethylamino-7-chlorofluoran,
3-diethylamino-7-methylfluoran,
3-diethylamino-6-methyl-7-anilinofluoran,
3-diethylamin-6-chloro-7-anilinofluoran,
3-pyrrolidino-7-(di-p-chlorophenylmethylamino)fluoran,
3-pyrrolidino-7-trifluoromethylanilinofluoran,
3-diethylamino-7-(m-trifluoromethylanilino)fluoran,
3-cyclohexylamino-6-chloro-7-(o-chloroanilino)fluoran,
3-diethylamino-5-chloro-7-(N-benzyl-trifluoromethylanilino)fluoran,
3-diethylamino-6-methyl-7-chlorofluoran,
3-dibutylamino-6-methyl-7-anilinofluoran,
3-diethylamino-7-(o-chloroanilino)fluoran,
3-butylamino-7-(o-fluoroanilino)fluoran,
3-(N-ethyl-N-amylamino)-7-anilinofluoran,
3-diethylamino-6-methyl-7-(m-trichloromethylanilino)fluoran,
3-pyrrolidino-6-methyl-7-anilinofluoran,
3-(N-cyclohexyl-N-methylamino)-6-methyl-7-anilinofluoran,
3-morpholino-7-(N-n-propyl-m-trifluoromethylanilino)fluoran,
3-(N-ethyl-p-toluidino)-6-methyl-7-anilinofluoran,
3-(N-ethyl-p-toluidino)-7-(α-phenylethylamino)fluoran,
3-(N-methyl-N-isobutylamino)-6-methyl-7-anilinofluoran,
3-(N-methyl-p-toluidino)-6-(t-butyl)-7-(p-toluidino)fluoran,
3-(N-ethylanilino)-6-methyl-7-(N-ethyl-p-toluidino)fluoran,
3-(N-ethyl-N-isoamylamino)-6-methyl-7-anilinofluoran,
3-diethylamino-5-chloro-7-(α-phenylethylamino)fluoran,
3-diethylamino-7-(o-methyoxycarbonylanilino)fluoran,
3-diethylamino-5-methyl-7-(α-phenylethylamino)fluoran,
3-diethylamino-7-piperidinofluoran,
3-diethylamino-6-methyl-7-mesidino-4,5'-benzofluoran,
3-diethylamino-6-methyl-7-(2,4-xylidino)fluoran,
3-diethylamino-5-methyl-7-dibenzylaminofluoran,
3-(N-methyl-N-isopropylamino)-6-methyl-7-anilinofluoran,
3-[N-ethyl-N-(2-ethoxypropyl)amino]-6-methyl-7-anilinofluoran,
3-(N-ethyl-N-tetrahydrofurfurylamino)-6-methyl-7-anilinofluoran,
3-(N-benzyl-N-cyclohexylamino)-5,6-benzo-7-(α-naphthylamino)-4'-bromofluoran,
2-chloro-3-(N-methyltoluidino)-7-(p-n-butylanilino)fluoran, and
3-diethylamino-7,8-benzofluoran.

Preferable examples of the color developer for use in the present invention are as follows:

(1) An organic phosphoric acid compound represented by general formula (5):

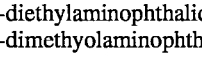

(5)

wherein $R^7$ is a straight-chain or branched alkyl group or alkenyl group having 8 to 30 carbon atoms.

Specific examples of the above organic phosphoric acid compound are octylphosphonic acid, nonylphosphonic acid, decylphosphonic acid, dodecylphosphonic acid, tetradecylphosphonic acid, hexadecylphosphonic acid, octadecylphosphonic acid, eicosylphosphonic acid, docosylphosphonic acid, and tetracosylphosphonic acid.

(2) An organic acid having hydroxyl group at the α-position carbon thereof represented by general formula (6):

$$R^8—CH(OH)COOH \quad (6)$$

wherein $R^8$ is a straight-chain or branched alkyl group or alkenyl group having 6 to 28 carbon atoms.

Specific examples of the organic acids having hydroxyl group at the α-position carbon thereof are α-hydroxyoctanoic acid, α-hydroxydodecanoic acid, α-hydroxytetradecanoic acid, α-hydroxyhexadecanoic acid, α-hydroxyoctadecanoic acid, α-hydroxypentadecanoic acid, α-hydroxyeicosanoic acid, and α-hydroxydocosanoic acid.

(3) A dibasic acid represented by general formula (7):

$$R^9—Z_t—\underset{\underset{CH_2—COOH}{|}}{CH}—COOH \quad (7)$$

wherein $R^9$ is a straight-chain or branched alkyl group or alkenyl group having 8 to 30 carbon atoms; Z is oxygen atom or sulfur atom; t is an integer of 0, 1 or 2.

Specific examples of the dibasic acid of general formula (7) are octylsuccinic acid, decylsuccinic acid, dodecylsuccinic acid, tetradecylsuccinic acid, hexadecylsuccinic acid, octadecylsuccinic acid, eicosylsuccinic acid, docosylsuccinic acid, tetracosylsuccinic acid, octylmalic acid, decylmalic acid, dodecylmalic acid, tetradecylmalic acid, hexadecylmalic acid, octadecylmalic acid, eicosylmalic acid, docosylmalic acid, tetracosylmalic acid, octylthiomalic acid, decylthiomalic acid, dodecylthiomalic acid, tetradecylthiomalic acid, hexadecylthiomalic acid, octadecylthiomalic acid, eicosylthiomalic acid, docosylthiomalic acid, tetracosylthiomalic acid, octyldithiomalic acid, decyldithiomalic acid, dodecyldithiomalic acid, tetradecyldithiomalic acid, hexadecylthiomalic acid, octadecyldithiomalic acid, eicosyldithiomalic acid, docosyldithiomalic acid, and tetracosyldithiomalic acid.

(4) a dibasic acid represented by general formula (8):

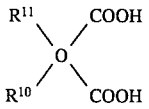

(8)

wherein $R^{10}$ is a straight-chain or branched alkyl group or alkenyl group having 8 to 30 carbon atoms; $R^{11}$ is hydrogen atom or an alkyl group having 1 to 30 carbon atoms;

Specific examples of the dibasic acid of general formula (8) are octylmalonic acid, decylmalonic acid, dodecylmalonic acid, tetradecylmalonic acid, hexadecylmalonic acid, octadecylmalonic acid, eicosylmalonic acid, docosylmalonic acid, tetracosylmalonic acid, dioctylmalonic acid, didecylmalonic acid, didodecylmalonic acid, ditetradecylmalonic acid, dihexadecylmalonic acid, dioctadecylmalonic acid, dieicosylmalonic acid, didocosylmalonic acid, methyloctadecylmalonic acid, methyleicosylmalonic acid, methyldocosylmalonic acid, methyltetracosylmalonic acid, ethyloctadecylmalonic acid, ethyleicosylmalonic acid, ethyldocosylmalonic acid, and ethyltetracosylmalonic acid.

(5) A phenolic compound represented by general formula (9):

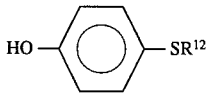

(9)

wherein $R^{12}$ is a straight-chain or branched alkyl group or alkenyl group having 8 to 30 carbon atoms.

Specific examples of the phenolic compound of general formula (9) are p-(octylthio)phenol, p-(nonylthio)phenol, p-(decylthio)phenol, p-(dodecylthio)phenol, p-(tetradecylthio)phenol, p-(hexadecylthio)phenol, p-(octadecylthio)phenol, p-(eicosylthio)phenol, p-(docosylthio)phenol, and p-(tetracosylthio)phenol.

Examples of a binder resin for use in the recording layer of the reversible thermosensitive recording medium of the present invention are as follows: polymethyl methacrylate, polyethyl methacrylate, polyisopropyl methacrylate, poly-n-butylmethacrylate, polyisobutyl methacrylate, polyphenyl methacrylate, polybenzyl methacrylate, poly(2-phenylethylmethacrylate), polyethylene, polypropylene, polystyrene, poly(p-methylstyrene), poly(p-t-butylstyrene), polyacenaphthylene, poly(2-vinylpyridine), polycarbonate, polyarylate, polysulfone, poly(2-phenylene ether sulfone), poly(N-vinylcarbazole), styrene-butadiene copolymer, styrene-acrylonitrile copolymer, styrene-butylmethacrylate copolymer, polyurethane, polyamide, polyetherimide, poly(1-naphthylmethacrylate, poly(5-indolylmethacrylate), poly(4-oxazolylmethacrylate), poly(3-phenanthrylmethacrylate, poly(7,7'-dimethyl-2-norbornylmethacrylate), poly(methylthiomethacrylate), poly(2-thiomethoxyethylmethacrylate), poly(p-N,N-dimethylaminostyrene), poly(p-N,N-dimethylaminotolylmethacrylate, poly(9-phenanethrylmethylmethacrylate), poly[2-(9-phenanethryl)ethylmethacrylate], alkyd resin, phenol-formaldehyde resin, epoxy resin, phenoxy resin, polyvinyl alcohol, vinyl alcohol-vinyl butyral copolymer, vinyl alcohol-vinyl acetate copolymer, polyvinyl formal, polyvinyl butyral, polyvinyl chloride, chlorinated polyvinyl chloride, vinyl chloride-vinyl acetate copolymer, vinyl chloride-vinyl acetate-vinyl alcohol copolymer, vinyl chloride-vinyl acetate-maleic anhydride copolymer, vinyl chloride-vinylidene chloride copolymer, chlorinated polyolefin, poly-p-vinylphenol, poly(2,6-dimethyl-p-phenyleneoxide), polytrifluoromethyl methacrylate, polyfluorovinylidene, nitrocellulose, cellulose acetate, cellulose triacetate, cellulose acetate butylate, cellulose acetate propionate, methyl cellulose, etheyl cellulose, hydroxyethyl cellulose, silicone resin, maleic anhydride resin, styrene-maleic anhydride copolymer, and isobutylene-maleic anhydride copolymer.

In the reversible thermosensitive recording medium of the present invention, each of the coloring agent, the color developer, the decolorization promoting agent and the binder resin can be used not only alone, but also in a plurality thereof in combination, in the recording layer.

Furthermore, in order to improve the coating characteristics or recording characteristics of the recording layer, varieties of additives such as dispersing agents, surfactants, fillers, colored image stabilizers, anti-oxidants, photostabilizers, and lubricants for use in conventional thermosensitive recording paper can also be employed in the recording layer of the reversible thermosensitive recording medium of the present invention.

In the recording layer of the reversible thermosensitive recording medium of the present invention, the color developer is employed in an amount of 1 to 50 parts by weight, preferably in an amount of 1 to 10 parts by weight, per one part by weight of a coloring agent, although the amounts of the color developer and coloring agent may vary depending upon the kinds of compounds and the combination of the compounds employed in the recording layer.

The decolorization promoting agent is generally employed in an amount of 0.1 to 1 part by weight per one part by weight of the coloring agent.

It is preferable that the binder resin be employed in an amount of 0.5 to 10 parts by weight to one part of the total weight of the above-mentioned three components, namely, the coloring agent, the color developer and the decolorization promoting agent.

It is also preferable that the recording layer have a thickness in a range of 3 to 20 μm, although there is no particular limitation to the thickness thereof.

When fabricating the reversible thermosensitive recording medium of the present invention, the recording thereof can be formed by applying a complete solution of the necessary components for the formation of the recording layer to a substrate. Hereinafter this method is referred to as a dissolution method.

However, in the case where there cannot be found an appropriate solvent in which all or part of the necessary components for the formation of the recording layer can be completely dissolved, insoluble components are uniformly dispersed in a solvent and the dispersion is applied to the substrate, whereby the recording layer can be formed. Hereinafter this method is referred to as a dispersion method.

To be more specific, in the dissolution method, a coloring agent, a color developer, a decolorization promoting agent, a binder resin, and additives if necessary, are uniformly dissolved in an appropriate solvent to prepare a coating liquid for the formation of the recording layer, and the thus prepared coating liquid is coated on a substrate, whereby a recording layer is formed; and in the dispersion method, the above-mentioned components for the formation of the recording layer are uniformly dispersed in a solvent to prepare a coating liquid and the thus prepared coating liquid is coated on a substrate, whereby a recording layer is formed on the substrate.

The dissolution method is suitable for the production of a reversible thermosensitive recording medium which is repeatedly used a number of times.

For the preparation of the above-mentioned coating liquid, dispersion apparatus such as ball mill, attritor, sand mill and Kady mill can be employed.

Specific examples of a solvent and a dispersion medium for the preparation of the above-mentioned coating liquid are as follows: water; aliphatic lower alcohols such as methanol, ethanol, and isopropanol, ketones such as acetone, 2-butanone, and cyclohexanone; aliphatic amides such as N,N-dimethylformamide (DMF) and N,N-dimethylacetoamide; sulfoxides such as dimethyl sulfoxide, cyclic amides such as N-methyl-2-pyrrolidone; amines such as n-butylamine and pyridine; cyclic ethers such as 2,3-dihydrofuran, 2,5-dihydrofuran, 4,5-dihydro-2-methylfuran, tetrahydrofuran, 2-methyltetrahydrofuran, 2,5-dimethoxytetrahydrofuran, 2,5-dimethyltetrahydrofuran, 3,4-dihydro-2H-pyran, 3,4-dihydro-2-methoxy-2H-pyran, 3,4-dihydro-2-ethoxy-2H-pyran, 5,6-dihydro-4-methoxy-2H-pyran, tetrahydropyran, 2-methyltetrahydropyran, 1,3-dioxane, 1,4-dioxane, 4-methyl-1,3-dioxane, 1,3-dioxolan, and 2-methyl-1,3-dioxolan; straight-chain ethers such as ethylene glycol monomethyl ether, ethylene glycol dimethyl ether, diethylene glycol monomethyl ether, and diethyl ether, easters such as ethyl acetate, isopropyl acetate, isobutyl acetate, ethylene carbonate, and propylene carbonate; aliphatic halogenated hydrocarbons such as methylene chloride, chloroform, dichloroethane, and 1,1,2-trichloroethane, hydrocarbons such as benzene, toluene, xylene, and ligroin; and aromatic halogenated hydrocarbons such as chlorobenzene and dichlorobenzene.

When fabricating the reversible thermosensitive recording medium of the present invention, the recording layer can be formed on the substrate by conventionally known coating methods, such as blade coating, wire bar coating, spray coating, dipping coating, bead coating, air-knife coating, and curtain coating.

With respect to the substrate for the reversible thermosensitive recording medium of the present invention, there is no particular limitation to the material therefor as long as the material can support the recording layer thereon.

Specific examples of the material for the substrate are paper; polyester film made of polyethylene terephthalate, polybutylene terephthalate or the like; cellulose-derivative film made of cellulose triacetate or the like; polyolefin film made of polypropylene, polyethylene or the like; polystyrene film; and laminated films prepared by laminating any of the above-mentioned films.

In the reversible thermosensitive recording medium of the present invention, there can be provided an undercoat layer between the support and the recording layer.

The undercoat layer is provided in order to improve the heat insulation of the recording layer, the adhesion between the substrate and the recording layer, and the durability of the substrate against a solvent which is used when forming the recording layer on the substrate.

When a heat-insulating undercoat layer is provided between the recording layer and the support, the thermal energy applied to the recording layer for recording can be effectively used, so that it is preferable to provide such a heat-insulating undercoat layer when producing a reversible thermosensitive recording medium for high speed recording.

Furthermore, a protective layer can be provided on the top surface of the recording layer in the reversible thermosensitive recording medium of the present invention in order to improve the resistance against chemicals, water, friction and light of the recording medium, and also to improve the head-matching properties of the recording medium.

Examples of such a protective layer include a coated film which is essentially made of a water-soluble polymer or which is formed by coating an aqueous emulsion essentially composed of a hydrophobic polymeric compound; and a coated film essentially made of a ultraviolet-curing resin or an electron-beam-curing resin.

By the provision of the protective layer, the repeated image formation and erasure thereof are not affected even when the reversible thermosensitive recording medium comes into contact with organic solvents, plasticizers, oils, sweat and water, or when the ambient temperature changes.

Furthermore, by containing a photostabilizer in the protective layer, the light resistance of the images and the background thereof can be significantly improved.

When an organic or inorganic filler and a lubricant are contained in the protective layer, the sticking problem which occurs when a thermal head or like comes into contact with the protective layer can be avoided, so that a reversible thermosensitive recording medium with excellent reliability and head-matching properties can be obtained.

The protective layer for the reversible thermosensitive recording medium of the present invention will now be explained in more detail.

There is no particular limitation to the water-soluble polymer and the aqueous emulsion of a hydrophobic polymeric compound for the formation of the protective layer in the present invention. Conventional water-soluble polymers and aqueous emulsions of hydrophobic polymer compounds can be employed.

Specific examples of the water-soluble polymer for the formation of the protective layer are as follows: polyvinyl alcohol, modified polyvinyl alcohol, starch and derivatives thereof, casein, cellulose derivatives such as methyl cellulose, methoxy cellulose and hydroxyethyl cellulose, gelatin, polyvinyl pyrrolidione, styrene-maleic anhydride copolymer, diisobutylene-maleic anhydride copolymer, polyacrylamide, modified polyacrylamide, methyl vinyl ether-maleic anhydride copolymer, carboxylic-modified polyethylene, polyvinyl alcohol-acrylamide block copolymer, melamine-formaldehyde resin, and urea-formaldehyde resin.

Examples of the hydrophobic polymeric compound for use in the above-mentioned aqueous emulsion for the formation of the protective layer are as follows: polyvinyl acetate, styrene-butadiene copolymer, styrene-butadiene-acryl copolymer, polyurethane, polyacrylic acid, polyacrylic ester, vinyl chloride-vinyl acetate copolymer, polybutyl methacrylate, and ethylene-vinyl acetate copolymer.

The above-mentioned resins can be used alone or in combination. When necessary, a curing agent may be added to these resins to cure the resins.

There is no particular limitation to the ultraviolet-curing resins for the formation of the protective layer. Varieties of conventional ultraviolet-curing resins can be employed.

When such ultraviolet-curing resins are used, there is a case where a solvent is used together with the ultraviolet-curing resins.

Specific examples of such a solvent are tetrahydrofuran, methyl ethyl ketone, methyl isobutyl ketone, chloroform, carbon tetrachloride, ethanol, isopropyl alcohol, ethyl acetate, butyl acetate, toluene, and benzene.

Instead of these solvents, a photopolymerizable monomer can be employed as a reactive diluent.

Specific examples of the photopolymerizable monomer are 2-ethylhexyl acrylate, cyclohexyl acrylate, butoxyethyl acrylate, neopentyl glycol diacrylate, 1,6-hexane diol diacrylate, polyethylene glycol diacrylate, trimethylolpropane triacrylate, and pentaerythritol triacrylate.

As the ultraviolet-curing resin for the formation of the protective layer in the present invention, any monomer or oligomer (or prepolymer) can be employed as long as a resin can be prepared thereform by the polymerization and curing thereof under ultraviolet radiation.

Specific examples of such a monomer or oligomer are (poly)ester acrylate, (poly)urethane acrylate, epoxy acrylate, polybutadiene acrylate, silicone acrylate, and melamine acrylate.

The (poly)ester acrylate is prepared by allowing (a) a polyhydric alcohol, such as 1,6-hexadiol, propylene glycol (in the form of propylene oxide) or diethylene glycol, and (b) a polybasic acid, such as adipic acid, phthalic anhydride or trimellitic acid, to react with (c) acrylic acid.

The following are the examples of the structure of the (poly)ester acrylate:

(a) Adipic acid/1,6-hexanediol/acrylic acid $$CH_2{=}CH{-}CO{-}O{-}(CH_2)_6{-}O{-}CO{-}(CH_2)_4{-}CO{-}O{-}(CH_2)_6{-}_n{-}O{-}CO{-}CH{=}CH_2$$

wherein n is an integer of 1 to 10.

(b) Phthalic anhydride/propylene oxide/acrylic acid

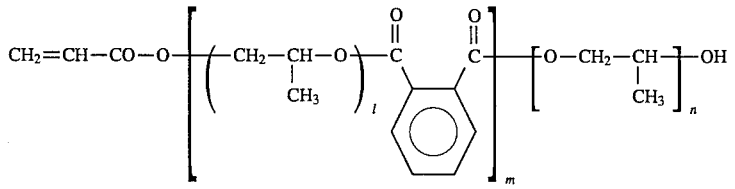

wherein l is an integer of 1 to 10, m is an integer of 1 to 10, and n is an integer of 1 to 10.

(c) Trimellitic acid/diethylene glycol/acrylic acid

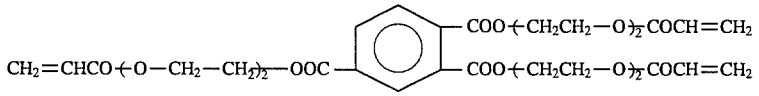

The (poly)urethane acrylate is obtained by allowing a compound having an isocyanate group, such as tolylene diisocyanate (TDI), to react with an acrylate having a hydroxyl group.

The structure of the (poly)urethane acrylate is:

(d) HEA/TDI/HDO/ADA/HDO/TDI/HEA, wherein HEA is 2-hydroxyethyl acrylate, HDO is 1,6-hexanediol, and ADA is adipic acid.

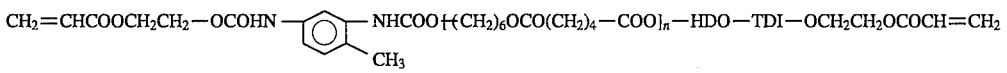

wherein n is an integer of 1 to 10.

Epoxy acrylate can be roughly classified into a Bisphenol A type, a novolak type, and an alicyclic type.

In these epoxy acrylates, the epoxy group of the epoxy resin is esterified with acrylic acid to convert it into an acryloyl group.

Examples of the structure of the epoxy acrylate are as follows:

(e) Bisphenol A—epichlorohydrin type/acrylic acid

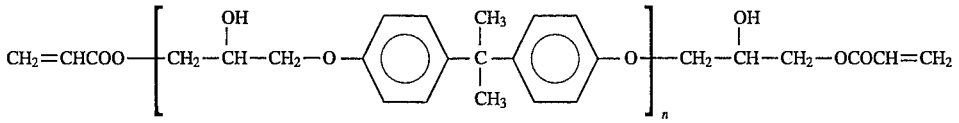

wherein n is an integer of 1 to 15.

(f) Phenolic novolak—epichlorohydrin type/acrylic acid

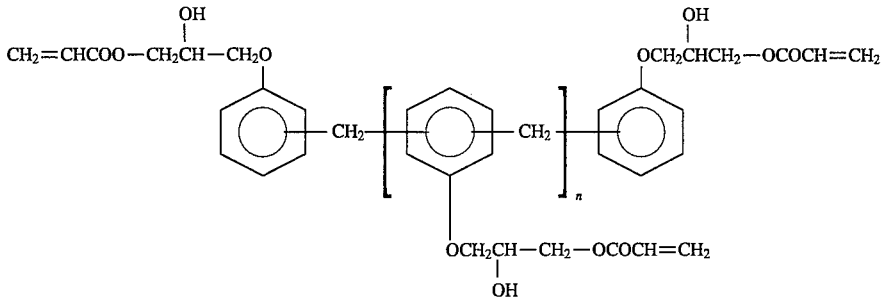

wherein n is an integer of 0 to 5.

(g) Alicyclic/acrylic acid

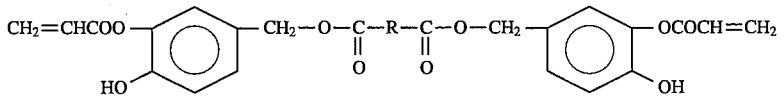

wherein R is $—(CH_2)_n—$, and n is an integer of 1 to 10.

Polybutadiene acrylate is prepared by allowing isocyanate or 1,2-mercaptoethanol to react with a 1,2-butadiene having a hydroxyl group at a terminal of the molecule thereof to obtain a reaction product, and then by allowing the reaction product to react with acrylic acid or the like.

An example of the structure of the polybutadiene acrylate is as follows:

(h) Polybutadiene acrylate

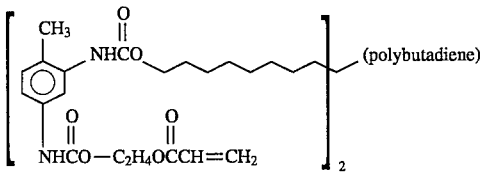

Silicone acrylate is obtained by methacryl modification of a reactive silicone compound, which is produced by a condensation reaction (methanol elimination reaction) between an organic functional trimethoxy silane and a silanol-group containing polysiloxane.

An example of the structure of the silicone acrylate is as follows:

(i) Silicone acrylate

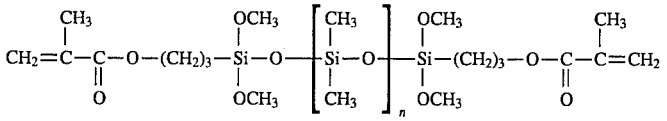

wherein n is an integer of 10 to 14.

There is no particular limitation to the coating method for the formation of the protective layer, and the thickness of the protective layer. However, it is preferable that the coating thickness for the formation of the protective layer be in a range of 0.1 to 20 μm, more preferably in the range of 0.5 to 10 μm, in view of the performance of the protective layer and the cost for the formation thereof.

So long as the coating thickness is in the above-mentioned range, the formed protective layer sufficient exhibits the desired performance thereof, and the recording performance of the reversible thermo-sensitive recording medium of the present invention is never impaired by the provision of the protective layer.

The light resistance of the reversible thermo-sensitive recording medium of the present invention can be improved by containing a photostabilizer in the protective layer. Specific examples of such a photostabilizer include a ultraviolet absorbing agent, an antioxidant, an anti-aging agent, a singlet oxygen extinction agent, and a superoxide anion extinction agent.

Specific examples of the ultraviolet absorbing agent are as follows:

(1) Benzophenone ultraviolet absorbing agents:
2,4-dihydroxybenzophenone,
2-hydroxy-4-methoxybenzophenone,
2-hydroxy-4-n-octoxybenzophenone
4-dodecyloxy-2-hydroxybenzophenone,
2,2'-dihydroxy-4-methoxybenzophenone,
2,2'-dihydroxy-4,4'-dimethoxybenzophenone,
2,2',4,4'-tetrahydroxybenzophenone,
2-hydroxy-4-methoxy-2'-carboxybenzophenone,
2-hydroxy-4-oxybenzylbenzophenone,
2-hydroxy-4-chlorobenzophenone,
2-hdyroxy-5-chlorobenzophenone,
2-hydroxy-4-methoxy-4'-methylbenzophenone,
2-hydroxy-4-n-heptoxybenzophenone,
2-hydroxy-3,6-dichloro-4-methoxybenzophenone,
2-hydroxy-3,6-dichloro-4-ethoxybenzophenone, and
2-hydroxy-4-(2-hydroxy-3-methylacryloxy)propoxybenzophenone.

(2) Benzotriazole ultraviolet absorbing agents:
2-(2-hydroxy-5-tolyl)benzotriazole,
2-(2-hydroxy-3,5-di-tert-butylphenyl)benzotriazole,
2-(2-hydroxy-3-tert-butyl-5-tolyl)benzotriazole,
2-(2-hydroxy-4-octoxy)benzotriazole,
2-(2-hydroxy-3,5-di-tert-butylphenyl)-5-chlorobenzotriazole,
2-(3-tert-butyl-2-hydroxy-5-tolyl)-5-chlorobenzotriazole, and
2-(2-hydroxy-5-ethoxyphenyl)benzotriazole.

(3) Phenyl salicylate ultraviolet absorbing agents:
phenyl salicylate,
p-octylphenyl salicylate,
p-tert-butylphenyl salicylate,
carboxyphenyl salicylate,
methylphenyl salicylate, and
dodecylphenyl salicylate.

(4) Other ultraviolet absorbing agents:
p-methoxybenzylidene malonic acid dimethyl ester,
3,5-di-tert-butyl-p-hydroxybenzoic acid.

(5) Ultraviolet absorbing agents which undergo rearrangements to benzophenone by ultraviolet absorption:
rersorcinol monobenzoate,
2,4-di-tert-butylphenyl, and
3,5-di-tert-butyl-4-hydroxybenzoate.

Specific examples of the antioxidant and anti-aging agent are as follows:
2,6-di-tert-butyl-4-cresol,
2,4,6-tri-tert-butylphenol,
styrenated phenol,
2,2'-methylenebis(4-methyl-6-tert-butylphenol),
4,4'-isopropylidenebisphenol,
2,6-bis(2-hydroxy-3-tert-butyl-5-methylbenzyl)-4-cresol,
4,4'-thiobis-(3-methyl-6-tert-butylphenol),
tetrakis-[methylene(3,5-di-tert-butyl-4-hydroxyhydrocinnamate)]methane,
p-hydroxyphenyl-3-naphthylamine,
2,2,4-trimethyl-1,2-dihydroquinoline,
thiobis(β-naphtol),
mercaptobenzothiazole,
mercaptobenzimidazole,
aldol-2-naphthylamine,
bis(2,2,6,6-tetramethyl-4-piperidyl)sebacate,
2,2,6,6-tetramethyl-4-piperidylbenzoate,
dilauryl-3,3'-thiodipropionate,
distearyl-3,3'-thiodibrominate, and
tris(4-nonylphenyl)phosphite.

Examples of the singlet oxygen extinction agent are carotene compounds, dyes, amine compounds, phenolic compounds, nickel complexes, and sulfide compounds.

Specific examples of such singlet oxygen extinction agents include:
1,4-diazacyclo(2,2,2)octane,
β-carotene,
1,3-cyclohexadiene,
2-diethylaminomethylfuran,
2-phenylaminomethylfuran,
9-diethylaminomethylanthracene,
5-diethylaminomethyl-6-phenyl-3,4-dihydroxypyran,
nickel dimethyl dithiocarbamate,
nickel dibutyl dithiocarbamate,
nickel 3,5-di-t-butyl-4-hydroxybenzyl-o-ethylphosphonate,
nickel 3,5-di-t-butyl-4-hydroxybenzyl-o-butylphosphonate,
nickel [2,2'-thiobis(4-t-octylphenolate)](n-butylamine),
nickel [2,2'-thiobis(4-t-octylphenolate)](2-ethylhexylamine),
nickel bis[2,2'-thiobis(4-t-octylphenolate)],
nickel bis[2,2'-sulfonebis(4-octylphenolate)],
nickel bis(2-hydroxy-5-methoxyphenyl-N-n-butylaldoimine,
nickel bis(dithiobenzyl), and
nickel bis(dithiobiacetyl).

Specific examples of the superoxide anion extinction agent are complexes of superoxide dismtase and cobalt [III] and nickel [II].

The above-mentioned agents can be used alone or in combination.

As mentioned previously, the head-matching performance of the reversible thermosensitive recording medium of the present invention can be improved by adding an organic or inorganic filler and a lubricant to the protective layer.

Specific examples of the organic filler for use in the present invention include polyolefin particles, polystyrene particles, urea-formaldehyde resin particles, and minute spherical void plastic particles.

Specific examples of the inorganic filler for use in the present invention include aluminum hydroxide, calcium carbonate (ground limestone and light-duty limestone), zinc oxide, titanium oxide, barium sulfate, silica gel, colloidal silica (10–50 μm), alumina sol (10–200 μm), activated clay, talc, kaolinite, calcined kaolinite, diatomaceous earth, synthetic kaolinite, zirconium compound, minute spherical void glass particles.

Specific examples of the lubricant are waves such as stearic acid amide, zinc stearate, palmitic acid amide, oleic acid amide, lauric acid amide, ethylenebis stearamide, methylenebis stearamide, methylol stearamide, paraffin wax, polyethylene wax, higher alcohol, higher fatty acid, higher fatty acid ester, and silicone compound. These lubricants can be used alone or in combination.

Images for recording can be formed by any heat application devices such as a thermal pen, a thermal head, a laser application device in accordance with the purpose of the recording, and there is no particular restriction to the choice of such heat application devices for image formation.

Likewise, there is no particular restriction to the choice of an image erasing device for use with the reversible thermosensitive recording medium of the present invention.

In the reversible thermosensitive recording medium of the present invention, however, colored images recorded in the recording medium are decolorized with time when allowed to stand at room temperature, so that a special image erasing apparatus for the application of heat to the recorded colored images is not always required, although such an image erasing apparatus may be used when necessary. In particular, the image erasing speed can be increased by applying heat to the recorded colored images, by use of, for example, a heat roller, a flat-surface heat emitting element, a temperature-constant chamber, a hot air application device, or a thermal head.

Other features of this invention will become apparent in the course of the following description of exemplary embodiments, which are given for illustration of the invention and are not intended to be limiting thereof.

EXAMPLE 1

[Fabrication of Reversible Thermosensitive Recording Medium No. 1 by Dispersion Method]

10 parts by weight of polymethyl methacrylate (Trademark "BR80" made by Mitsubishi Rayon Engineering Co., Ltd.) were completely dissolved in 90 parts by weight of a mixed solvent of toluene/2-butanone=1/1 (weight ratio).

To this solution, 2 parts by weight of 3- dibutylamino-7-(o-chloroanilino)fluoran and 0.5 parts by weight of phytantriol serving as a decolorization promoting agent were added and completely dissolved in the mixture.

To the thus obtained solution, 6.7 parts by weight of octadecylphosphonic acid were added, and the mixture was uniformly dispersed in a ball mill for 48 hours, whereby a coating liquid for the formation of a recording layer was prepared.

The thus prepared coating liquid was coated on a corona-treated surface of a polyester film with a thickness of 75 μm by a wire bar and dried with application of heat thereto, whereby a recording layer with a thickness of about 10 μm was formed on the polyester film.

Thus, a reversible thermosensitive recording medium No. 1 of the present invention was fabricated.

EXAMPLES 2 TO 5

[Fabrication of Reversible Thermosensitive Recording Media Nos. 2–5 by Dispersion Method]

The procedure for the fabrication of the reversible thermosensitive recording medium No. 1 of the present invention in Example 1 was repeated except that the phytantriol serving as a decolorization promoting agent employed in Example 1 was replaced by the respective decolorization promoting agents listed in TABLE 1, whereby reversible thermosensitive recording media Nos. 2 to 5 of the present invention were fabricated.

TABLE 1

| Example No. | Decolorization Promoting Agent | Corresponding General Formula |
|---|---|---|
| 2 | trimethylolheptadecane | (2) |
| 3 | trimethylolisoheptadecane | (2a) |
| 4 | N-tris(hydroxymethyl)-isostearic acid amide | (3a) |
| 5 | 2,4,7,9-tetramethyl-5,-decyne-4,7-diol | (4) |

EXAMPLE 6

[Fabrication of Reversible Thermosensitive Recording Medium No. 6 by Dissolution Method]

10 parts by weight of polymethyl methacrylate (Trademark "BR80" made by Mitsubishi Rayon Engineering Co., Ltd.) were completely dissolved in 90 parts by weight of 3,4-dihydro-2H-pyran.

To this solution, 2 parts by weight of 3-dibutylamino-7-(o-chloroanilino)fluoran, 6.7 parts by weight of octadecylphosphonic acid, and 0.5 parts by weight of phytantriol were added and completely dissolved therein, whereby a uniform coating liquid was prepared.

The thus prepared coating liquid was coated on a corona-treated surface of a polyester film with a thickness of 75 μm by a wire bar and dried with application of heat thereto, whereby a recording layer with a thickness of about 10 μm was formed on the polyester film.

Thus, a reversible thermosensitive recording medium No. 6 of the present invention was fabricated.

EXAMPLES 7–22

[Fabrication of Reversible Thermosensitive Recording Media Nos. 7–22 by Dissolution Method]

The procedure for the fabrication of the reversible thermosensitive recording medium No. 6 of the present invention in Example 6 was repeated except that the phytantriol serving as a decolorization promoting agent employed in Example 6 was replaced by the respective decolorization promoting agents listed in TABLE 2, whereby reversible thermosensitive recording media Nos. 7 to 22 of the present invention were fabricated.

TABLE 2

| Example No. | Decolorization Promoting Agent | Corresponding General Formula |
|---|---|---|
| 7 | 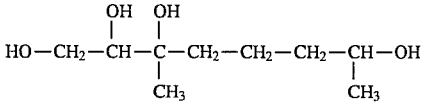 | (1) |
| 8 | 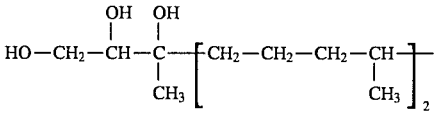 | (1) |
| 9 | trimethylolundecane | (2) |
| 10 | trimethyloltridecane | (2) |
| 11 | trimethylolheptadecane | (2) |
| 12 | trimethylolnonadecane | (2) |
| 13 | trimethylolheneicosane | (2) |
| 14 | trimethylolisoheptadecane | (2a) |
| 15 | N-tris(hydroxymethyl)-myristic acid amide | (3) |
| 16 | N-tris(hydroxymethyl)-palmitic acid amide | (3) |
| 17 | N-tris(hydroxymethyl)-stearic acid amide | (3) |
| 18 | N-tris(hydroxymethyl)-oleic amide | (3c) |
| 19 | N-tris(hydroxymethyl)-isostearic acid amide | (3a) |
| 20 | N-tris(hydroxymethyl)-isopalmitic acid amide | (3a) |
| 21 | 3,6-dimethyl-4-octyn-3,6-diol | (4) |
| 22 | 2,4,7,9-tetramethyl-5-decyn-4,7-diol | (4) |

EXAMPLES 23–32

[Fabrication of Reversible Thermosensitive Recording Media Nos. 23–32 by Dissolution Method]

The procedure for the fabrication of the reversible thermosensitive recording medium No. 6 of the present invention in Example 6 was repeated except that the coloring agent, the color developer and the solvent employed in Example 6 were respectively replaced by the respective coloring agents, color developers and solvents listed in the following TABLE 3, whereby reversible thermosensitive recording media Nos. 23 to 32 of the present invention were fabricated:

TABLE 3

| Example No. | Coloring Agent | Color Developer | Solvents |
|---|---|---|---|
| 23 | 3-(N-methyl-N-isopropyl)amino-6-methyl-7-anilinofluoran | hexadecyl-phosphonic acid | 3,4-dihydro-2H-pyran |
| 24 | 3-(N-isoamyl-N-ethyl)amino-7,8-dibenzofluorane | eicosyl-phosphonic acid | 3,4-dihydro-2H-pyran |
| 25 | 3-diethylamino-7-(o-chloroanilino)fluoran | α-hydroxy-octadecanoic acid | 3,4-dihydro-2H-pyran |
| 26 | 3-(N-methyl-p-toluidino)-6-methyl-7-anilinofluoran | α-hydroxy-eicosanoic acid | 3,4-dihydro-2H-pyran |
| 27 | 3-(N-cyclohexyl-N-n-dodecylamino)-6-methyl-7-anilinofluoran | octadecylthio-malic acid | tetrahydrofuran/ tetrahydropyran = 1/1 (weight ratio) |
| 28 | 3-(N-n-hexyl-N-n-pentylamino)-6-methyl-7-anilinofluoran | eicosylthio-malic acid | tetrahydrofuran/ tetrahydropyran = 1/1 (weight ratio) |
| 29 | 3-cyclohexylamino-6-chloro-7-anilinofluoran | octadecyl-malonic acid | tetrahydrofuran/ tetrahydropyran = 1/1 (weight ratio) |
| 30 | 3-diethylamino-6-methyl-7-dibenzylaminofluoran | eicosylmalonic acid | tetrahydrofuran/ tetrahydropyran = 1/1 (weight ratio) |
| 31 | 3-(N-cyclohexyl-N-n-decylamino)-6-methyl-7-anilinofluoran | p-hexadecyl-thiophenol | tetrahydrofuran/ tetrahydropyran = 1/1 (weight ratio) |
| 32 | 3-dibutylamino-6-methyl-7-anilinofluoran | p-eicosyl-thiophenol | tetrahydrofuran/ tetrahydropyran = 1/1 (weight ratio) |

EXAMPLES 33–38

[Fabrication of Reversible Thermosensitive Recording Media Nos. 33–38 by Dissolution Method]

The procedure for the fabrication of the reversible thermosensitive recording medium No. 6 of the present invention in Example 6 was repeated except that the binder resin employed in Example 6 was replaced by the respective binder resins listed in TABLE 4, whereby reversible thermosensitive recording media Nos. 33 to 38 of the present invention were fabricated.

TABLE 4

| Example No. | Binder resin |
|---|---|
| 33 | Poly-n-butyl methacrylate (Trademark "BR102", made by Mitsubishi Rayon Engineering Co., Ltd.) |
| 34 | Bisphenol Z polycarbonate (made by Teijin Chemicals Ltd.) |
| 35 | Styrene - butadiene copolymer (Trademark "Clearen 730-L", made by Denki Kagaku Kogyo Kabushiki Kaisha) |
| 36 | Vinyl chloride - vinyl acetate copolymer (Trademark "VYHH", made by UCC Company, Ltd.) |
| 37 | Polyurethane (Trademark "P22SRNAT", made by Nippon Polyurethane Industry Co., Ltd.) |
| 38 | Cellulose acetate butyrate (Trademark "CAB381-0.5", made by Eastman Kodak Co.,) |

EXAMPLES 39 TO 43

[Fabrication of Reversible Thermosensitive Recording Media Nos. 39–43 by Dissolution Method]

The procedure for the fabrication of the reversible thermosensitive recording medium No. 6 of the present invention in Example 6 was repeated except that a protective layer with a thickness of about 3 μm was formed on the recording layer, by coating a protective layer coating liquid with the respective formulations listed in TABLE 5, and drying the coated liquid with application of heat thereto or curing the same with ultraviolet irradiation, whereby reversible thermosensitive recording media Nos. 39 to 43 of the present invention were fabricated.

TABLE 5

| Example No. | Formulation of Coating Liquid for Formation of Protective Layer | Parts by Weight |
|---|---|---|
| 39 | 2-(2'-hydroxy-5'-tolyl)-benzotriazole | 16 |
| | 10% aqueous solution of carboxyl-group-modified polyvinyl alcohol | 50 |
| | 10% aqueous solution of epichlorohydrin/polyamide copolymer | 20 |
| | Potassium carbonate | 1 |
| | Water | 29 |
| 40 | p-tert-butylphenyl-salicylate | 16 |

TABLE 5-continued

| Example No. | Formulation of Coating Liquid for Formation of Protective Layer | Parts by Weight |
|---|---|---|
| | 10% aqueous solution of carboxyl-group-modified polyvinyl alcohol | 50 |
| | 10% aqueous solution of epichlorohydrin/polyamide copolymer | 20 |
| | Potassium carbonate | 3 |
| | Polyethylene wax | 1 |
| | Water | 29 |
| 41 | 75% butyl acetate solution of urethane-acrylate-based ultraviolet curing resin (Trademark "Unidic 17-824-9", made by Dainippon Ink & Chemicals, Inc.) | 100 |
| | Potassium carbonate (Trademark "Callight SA", made by Shiraishi Calcium Kaisha, Ltd.) | 2 |
| | Polyethylene wax | 1 |
| | Toluene | 100 |
| | After coating, curing was conducted with ultraviolet radiation by use of a ultra violet lamp with a light intensity of 80 W/cm. | |
| 42 | 75% butyl acetate solution of urethane-acrylate-based ultraviolet curing resin (Trademark "Unidic C7-157", made by Dainippon Ink & Chemicals, Inc.) | 100 |
| | Alumina sol (100–200 μm) | 3 |
| | Stearic acid amide | 3 |
| | Butyl acetate | 50 |
| | After coating, curing was conducted with ultraviolet radiation by use of a ultra violet lamp with a light intensity of 80 W/cm. | |
| 43 | 75% butyl acetate solution of urethane-acrylate-based ultraviolet curing resin (Trademark "Unidic C7-157", made by Dainippon Ink & Chemicals, Inc.) | 100 |
| | Silica (Trademark "Syloid 244", made by Fuji-Davison Chemical Ltd.) | 2 |
| | Zinc stearate | 1 |
| | Toluene | 100 |
| | After coating, curing was conducted with ultraviolet radiation by use of a ultra violet lamp with a light intensity of 80 W/cm. | |

COMPARATIVE EXAMPLE 1

The procedure for the fabrication of the reversible thermosensitive recording medium No. 6 of the present invention in Example 6 was repeated except that the phytantriol serving as a decolorization promoting agent employed in Example 6 was eliminated from the formulation of the recording layer in Example 6, whereby a comparative reversible thermosensitive recording medium No. 1 was fabricated.

COMPARATIVE EXAMPLE 2

[Preparation of Liquid A]

A mixture of the following components was dispersed in a sand mill until the solid particles contained therein were pulverized to particles with an average particle size of 2 μm or less, whereby liquid A was prepared:

[Formulation of Liquid A]

| | Parts by Weight |
|---|---|
| 3-dibutylamino-7-(o-chloroanilino)fluoran | 5 |
| 2.5% aqueous solution of polyvinyl alcohol | 45 |

[Preparation of Liquid B]

A mixture of the following components was dispersed in a sand mill until the solid particles contained therein were pulverized to particles with an average particle size of 2 μm or less, whereby Liquid B was prepared:

[Formulation of Liquid B]

| | Parts by Weight |
|---|---|
| Bisphenol A | 10 |
| p-benzylbiphenyl | 10 |
| Adduct prepared by the addition of 85 moles of ethylene oxide to 1 mole of nonylphenol (a decolorization promoting agent disclosed in Japanese Laid-Open Patent Application 4-14482) | 10 |
| 2.5% aqueous solution of polyvinyl alcohol | 80 |

The thus prepared Liquid A and Liquid B were mixed. To this mixture, Liquid C with the following formulation was added and the mixture thereof was sufficiently mixed, whereby a coating liquid for the formation of a recording layer was prepared:

[Formulation of Liquid C]

| | Parts by Weight |
|---|---|
| 30% dispersion liquid of potassium carbonate | 30 |
| 30% dispersion liquid of paraffin wax | 15 |

The thus prepared coating liquid was coated on a corona-treated surface of a polyester film with a thickness of 75 μm by a wire bar and dried with application of heat thereto, whereby a recording layer with a thickness of about 10 μm was formed on the polyester film.

Thus, a comparative reversible thermosensitive recording medium No. 2 was fabricated.

COMPARATIVE EXAMPLE 3

The procedure for the fabrication of the reversible thermosensitive recording medium No. 6 of the present invention in Example 6 was repeated except that the phytantriol serving as a decolorization promoting agent employed in Example 6 was replaced by lignoceric acid serving as a decolorization promoting agent, which is disclosed in Japanese Laid-Open Patent Application 5-294063, whereby a comparative reversible thermosensitive recording medium No. 3 was fabricated.

COMPARATIVE EXAMPLE 4

The procedure for the fabrication of the reversible thermosensitive recording medium No. 6 of the present invention in Example 6 was repeated except that the phytantriol serving as a decolorization promoting agent employed in Example 6 was replaced by stearyl alcohol serving as a decolorization promoting agent, which is disclosed in Japanese Laid-Open Patent Application 6-155905, whereby a comparative reversible thermosensitive recording medium No. 4 was fabricated.

The thus fabricated reversible thermosensitive recording media Nos. 1 to 43 of the present invention and comparative reversible thermosensitive recording media Nos. 1 to 4 were subjected to a thermal printing test by use of a thermal head with the application of printing thermal energy of 16 $mJ/mm^2$ thereto, and the reflection image density of the formed image in each of the above recording media was measured by a Macbeth densitometer RD-918.

Each of the image-bearing recording media was allowed to stand at 25° C. in a temperature-constant chamber for 24 hours, in order to decolorize the formed images, and then the reflection image density of the image subjected to this decolorization in each of the recording media was also measured by the above-mention Macbeth densitometer RD-918.

This thermal printing and image erasure operation was repeated 10 times for the reversible thermosensitive recording media Nos. 1 to 38 of the present invention and the comparative reversible thermosensitive recording media Nos. 1 to 3, and the same thermal printing and image erasure operation as mentioned above was repeated 50 times for the reversible thermosensitive recording media Nos. 39 to 43 of the present invention and the comparative reversible thermosensitive recording medium No. 4, so that the reflection density of the formed image and that of the erased image at the 10th or 50th operation were measured with respect to the each of the above recording media.

The results are shown in the following TABLES 6 and 7:

TABLE 6

| | Image Density at 1st Operation | | Image Density at 10th Operation | |
|---|---|---|---|---|
| | Immediately after recording | When erased | Immediately after recording | When erased |
| Ex. 1 | 1.24 | 0.13 | 1.20 | 0.18 |
| Ex. 2 | 1.15 | 0.14 | 1.09 | 0.19 |
| Ex. 3 | 1.20 | 0.14 | 1.15 | 0.18 |
| Ex. 4 | 1.24 | 0.12 | 1.20 | 0.16 |
| Ex. 5 | 1.16 | 0.11 | 1.10 | 0.14 |
| Comp. Ex. 1 | 1.30 | 1.01 | 1.32 | 1.21 |
| Comp. Ex. 2 | 0.60 | 0.09 | 0.30 | 0.12 |
| Comp. Ex. 3 | 1.25 | 0.13 | 1.20 | 0.32 |
| Example No. | | | | |
| 6 | 1.31 | 0.14 | 1.29 | 0.16 |
| 7 | 1.09 | 0.14 | 1.05 | 0.16 |
| 8 | 1.24 | 0.15 | 1.18 | 0.17 |
| 9 | 1.19 | 0.17 | 1.15 | 0.19 |
| 10 | 1.21 | 0.15 | 1.18 | 0.18 |
| 11 | 1.22 | 0.15 | 1.24 | 0.17 |
| 12 | 1.24 | 0.14 | 1.21 | 0.16 |
| 13 | 1.29 | 0.15 | 1.26 | 0.18 |
| 14 | 1.30 | 0.15 | 1.28 | 0.16 |
| 15 | 1.18 | 0.18 | 1.15 | 0.21 |
| 16 | 1.23 | 0.18 | 1.21 | 0.21 |
| 17 | 1.28 | 0.17 | 1.26 | 0.20 |

TABLE 6-continued

| | Image Density at 1st Operation | | Image Density at 10th Operation | |
|---|---|---|---|---|
| | Immediately after recording | When erased | Immediately after recording | When erased |
| 18 | 1.31 | 0.17 | 1.34 | 0.19 |
| 19 | 1.36 | 0.15 | 1.38 | 0.16 |
| 20 | 1.31 | 0.14 | 1.33 | 0.15 |
| 21 | 1.18 | 0.17 | 1.21 | 0.19 |
| 22 | 1.26 | 0.14 | 1.29 | 0.16 |
| 23 | 1.41 | 0.21 | 1.43 | 0.21 |
| 24 | 1.11 | 0.12 | 1.14 | 0.13 |
| 25 | 1.08 | 0.10 | 1.10 | 0.12 |
| 26 | 1.05 | 0.09 | 1.03 | 0.12 |
| 27 | 1.07 | 0.12 | 0.99 | 0.14 |
| 28 | 0.98 | 0.11 | 0.97 | 0.13 |
| 29 | 1.00 | 0.13 | 0.98 | 0.14 |
| 30 | 0.89 | 0.09 | 0.92 | 0.11 |
| 31 | 0.91 | 0.09 | 0.93 | 0.11 |
| 32 | 0.90 | 0.08 | 0.91 | 0.10 |
| 33 | 1.26 | 0.17 | 1.23 | 0.19 |
| 34 | 1.08 | 0.09 | 1.06 | 0.12 |
| 35 | 1.13 | 0.09 | 1.06 | 0.12 |
| 36 | 0.99 | 0.14 | 0.96 | 0.16 |
| 37 | 0.80 | 0.07 | 0.82 | 0.09 |
| 38 | 1.21 | 0.19 | 1.25 | 0.21 |

TABLE 7

| | Image Density at 1st Operation | | Image Density at 50th Operation | |
|---|---|---|---|---|
| Example No. | Immediately after recording | When erased | Immediately after recording | When erased |
| 39 | 1.16 | 0.13 | 1.19 | 0.15 |
| 40 | 1.19 | 0.14 | 1.22 | 0.16 |
| 41 | 1.21 | 0.15 | 1.23 | 0.16 |
| 42 | 1.25 | 0.16 | 1.23 | 0.17 |
| 43 | 1.26 | 0.15 | 1.24 | 0.17 |
| Comp. Ex. 4 | 1.16 | 0.14 | 1.22 | 0.23 |

The results shown in the above TABLES 6 and 7 indicate that all of the reversible thermosensitive recording media Nos. 1 to 43 of the present invention have much better erasability with time than any of the comparative reversible thermosensitive recording media Nos. 1 to 4 when the thermal printing and image erasure operation was repeated 10 times or more.

In particular, the comparative reversible thermosensitive recording media No. 1 fabricated in Comparative Example 1, which did not contain any decolorization promoting agent, exhibited so poor erasability with time that when this comparative recording medium was subjected to one thermal printing and image erasure operation, the decolorization with time became extremely difficult thereafter.

In the comparative reversible thermosensitive recording medium No. 2 fabricated in Comparative Example 2, in which the decolorization promoting agent disclosed in Japanese Laid-Open Patent Application 4-14482 was used, the low coloring density was produced from the initial thermal recording operation, so that this comparative reversible thermosensitive recording medium is not considered practically usable unless the coloring agent and color developer therefor are selected with the utmost care.

All of the reversible thermosensitive recording media Nos. 1 to 43 of the present invention were able to maintain high recorded image density and low erased image density from the 1st through 10th thermal printing operation.

In particular, the reversible thermosensitive recording media Nos. 39 to 43 fabricated in Examples 39 to 43, each provided with the protective layer, exhibited excellent performance with respect to the high recorded image density and low erased image density.

To be more specific, in the reversible thermosensitive recording media Nos. 39 to 43 fabricated in Examples 39 to 43, substantially the same high recorded image density and low erased image density are maintained at the 1st and 50th thermal printing and image erasure operation.

In contrast to this, the comparative reversible thermosensitive recording medium No. 4, in which the decolorization promoting agent disclosed in Japanese Laid-Open Patent Application 6-155905 was employed, the recorded image density and erased image density considerably increased at the 50th thermal printing and image erasure operation.

Japanese Patent Application No. 06-170019 filed on Jun. 29, 1994 is hereby incorporated by reference.

What is claimed is:

1. A reversible thermosensitive recording medium comprising a substrate and a recording layer formed thereon, said recording layer comprising:

(a) an electron donor coloring compound, (b) an electron acceptor compound capable of inducing color formation in said electron donor coloring compound, (c) a decolorization promoting agent comprising at least one long chain aliphatic compound including three hydroxyl groups at a terminal portion of the molecule thereof, and (d) a binder resin.

2. The reversible thermosensitive recording medium as claimed in claim 1, wherein said long chain aliphatic compound is selected form the group consisting of a compound (1) of formula (1), a compound (2) of formula (2) and a compound (3) of formula (3):

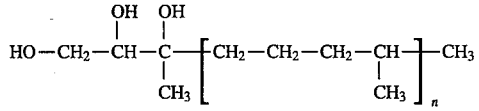

(1)

wherein n is an integer of 1 to 3;

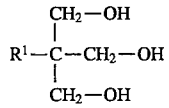

(2)

wherein $R^1$ is a straight or branched chain alkyl group or alkenyl group having 8 to 22 carbon atoms; and

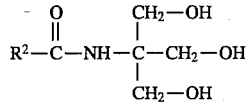

(3)

wherein $R^2$ is a straight or branched chain alkyl group or alkenyl group having 7 to 27 carbon atoms.

3. The reversible thermosensitive recording medium as claimed in claim 2, wherein said compound of formula (1) is phytantriol in which n is 3.

4. The reversible thermosensitive recording medium as claimed in claim 2, wherein $R^1$ in said compound of formula (2) is a branched alkyl group having 16 carbon atoms.

5. The reversible thermosensitive recording medium as claimed in claim 2, wherein $R^2$ in said compound of formula (3) is a a branched alkyl group or alkenyl group having 13 to 19 carbon atoms.

6. A reversible thermosensitive recording medium comprising a substrate and a recording layer formed thereon, said recording layer comprising:

(a) an electron donor coloring compound, (b) an electron acceptor compound capable of inducing color formation in said electron donor compound, (c) a decolorization promoting agent which is an acetylene glycol compound of formula (4):

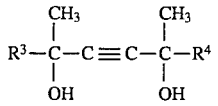

(4)

wherein $R^3$ and $R^4$ may be the same or different and represent an alkyl group having 1 to 4 carbon atoms, and (d) a binder resin.

* * * * *

UNITED STATES PATENT AND TRADEMARK OFFICE

CERTIFICATE OF CORRECTION

PATENT NO. : 5,583,088

DATED : December 10, 1996

INVENTOR(S) : Fumio KAWAMURA

It is certified that error appears in the above-identified patent and that said Letters Patent is hereby corrected as shown below:

Column 4, lines 30-31, "alcohol-obtained" should read --alcohol obtained--.

Column 5, line 38, "2,5-dimethyl-3-hexyne-2,5-diol," should read --2,5-dimethyl-3-hexane-2,5-diol,--.

Column 15, line 21, "sufficient" should read --sufficiently--.

line 29, "include a" should read --include an--.

Column 17, line 16, "waves" should read --waxes--.

UNITED STATES PATENT AND TRADEMARK OFFICE

CERTIFICATE OF CORRECTION

PATENT NO. : 5,583,088

DATED : December 10, 1996

INVENTOR(S) : Fumio KAWAMURA

It is certified that error appears in the above-identified patent and that said Letters Patent is hereby corrected as shown below:

Column 19, Table 2, Example 8, " 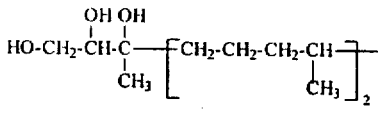 (1) "

should read -- 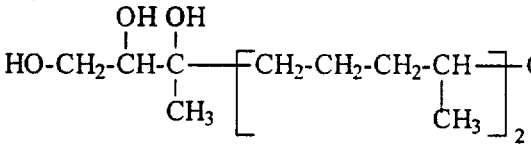 (1)--.

Column 24, line 25, "above-mention" should read --above-mentioned--.

Signed and Sealed this

Fourteenth Day of July, 1998

Bruce Lehman

*Attest:*

BRUCE LEHMAN

*Attesting Officer*

*Commissioner of Patents and Trademarks*